United States Patent [19]

Budris

[11] 4,097,186

[45] Jun. 27, 1978

[54] MULTI-STAGE RING TYPE CENTRIFUGAL PUMPS WITH INDUCER MEANS

[75] Inventor: Allan R. Budris, Nutley, N.J.

[73] Assignee: Worthington Pump, Inc., Mountainside, N.J.

[21] Appl. No.: 742,899

[22] Filed: Nov. 18, 1976

[51] Int. Cl.[2] ..... F04D 29/44; F01D 5/22

[52] U.S. Cl. ..... 415/143; 415/199.6; 415/DIG. 3; 416/177; 416/183

[58] Field of Search ..... 415/143, 199.6, 199.3, 415/215, DIG. 3; 416/177, 178, 183

[56] References Cited

U.S. PATENT DOCUMENTS

| | | | |
|---|---|---|---|
| 1,080,655 | 12/1913 | Richardson | 415/199.3 X |
| 3,221,661 | 12/1965 | Swearingen | 415/143 |
| 3,522,997 | 8/1970 | Rylewski | 415/143 |

FOREIGN PATENT DOCUMENTS

| | | | |
|---|---|---|---|
| 899,123 | 7/1944 | France | 415/199.6 |
| 1,218,023 | 1/1971 | United Kingdom | 415/143 |

*Primary Examiner*—Carlton R. Croyle
*Assistant Examiner*—Donald S. Holland
*Attorney, Agent, or Firm*—Daniel H. Bobis

[57] ABSTRACT

Multi-Stage ring type centrifugal pumps for pumping fluids are adapted to receive an inducer shaped and sized generally but not necessarily to replace the impeller and diffuser of the first pumping stage of the given centrifugal pump. The preferred type of inducer for this use has an enlarged inlet diameter, at least two inducer vanes; an outlet diameter less than the inlet diameter to provide generally convergent flow passages, and the selected inlet vane angle for the inducer vanes will provide a positive incidence angle to increase the pressure at the suction inlet of the associated stage impeller into which the fluid being pumped is delivered.

The inductor is shown in various forms. One embodiment includes an integral hub, inducer vanes and outer shroud. A second male type embodiment includes an integral hub and inducer vanes, and an operatively associated fixed outer shroud matched to the outer periphery of the inducer vanes. A third female type embodiment includes an integral outer shroud and inducer vanes, and an operatively associated separate shaft sleeve matched to the inner periphery of the inducer vanes. Where the outer shroud is rotatable as in the first and second embodiment the inducer is provided with a wearing ring sealing assembly to retain the pressure developed by the inducer.

27 Claims, 21 Drawing Figures

MULTI-STAGE RING TYPE CENTRIFUGAL PUMPS WITH INDUCER MEANS

BACKGROUND OF THE INVENTION

This invention relates generally to centrifugal pumps and more particularly to a multi-stage ring type centrifugal pump adapted to receive an inducer preferably but not necessarily by direct replacement of the first pumping stage for such pump and generally without need for an adapter or any special parts.

Inducers for use in centrifugal pumps are well known in the prior art. Inducers have not generally been used in side suction, multi-stage centrifugal pumps, which normally have relatively high Net Positive Suction Head (NPSH) requirements; a need therefore has arisen in multi-stage centrifugal pumps where such pumps are used in boiler feed applications wherein the pumps must satisfactorily handle water at elevated temperatures approaching the boiling point therefor which results in relatively low NPSH at the inlet to the pump.

One major reason for non-use of inducers in such pumps resides in the fact that sufficient space is simply not available in the overall pump configuration to incorporate an inducer therein.

It may also be understood that a need currently exists for an inducer which may readily be utilized in end suction, multistage centrifugal pumps having such high NPSH requirements.

Additional problems of significance regarding the inducers of the prior art are that operation of many of the same, especially in the higher pump flow ranges, is particularly conductive to cavitation and/or turbulence, with attendant damaging and/or flow throttling consequences therefor.

Prior art inducers will generally not be readily adapted to centrifugal pumps not originally designed for operation with an inducer, but rather, will be found to require the use of special parts and adapters, and/or relatively extensive modification of the pumps, to permit use with an inducer, all of which is costly and expensive and therefore constitutes a significant economic disadvantage.

The present invention seeks to overcome these problems by providing a multi-stage ring type centrifugal pump adaptable for use with an inducer wherein the inducer generally is adaptable to replace directly the first pumping stage of the given multi-stage centrifugal pump without requiring an adaptor or special fixture therefor. The inducer is also shaped and sized for such replacement and has an enlarged inlet diameter, at least two inducer vanes, and an outlet diameter less than the inlet diameter to provide generally convergent flow passages, and the leading edge of the inducer vanes has a positive incidence angle so that on operation of the centrifugal pump the inducer will provide an increase in the pressure of the pressure delivered at the suction eye of the operatively associated stage impeller in the pump.

The improvement in accordance with the present invention requires that both the multi-stage ring type centrifugal pump and the inducer be sized and shaped relative each other so that the inducer will generally but not necessarily be adapted to fit into the position normally occupied by the impeller and diffuser of the first pumping stage.

SUMMARY OF THE INVENTION

Thus, the present invention covers a multi-stage ring type centrifugal pump having, a pump casing comprising an inlet passage for fluid to be pumped and an outlet for pumped fluid, a plurality of serially arranged pumping stages, a pump shaft extending through said serially arranged pumping stages and rotatable relative thereto, impellers in each of said pumping stages connected to and driven by said pump shaft, an inducer means, said inducer means disposed relative the pump shaft and operative to pass pumped fluid from the inlet passage in the said centrifugal pump to the first of the impellers for the plurality of serially arranged pumping stages and the last of the impellers in the said centrifugal pump to deliver the pumped fluid from said serially arranged pumping stages to the outlet for said centrifugal pump.

Additionally, the present invention covers a multi-stage ring type centrifugal pump as above described, wherein the inducer means is sized and shaped to permit the same to be mounted in the position in said centrifugal pump normally occupied by the impeller and diffuser of the first pumping stage therein, the inducer means preferably but not necessarily providing generally convergent flow passages between the inlet and the outlet for the inducer, and the inducer vanes having a positive incidence angle.

Additionally, the present invention covers inducer means for a multi-stage ring type centrifugal pump having, an inner member, an annular outer member or shroud spaced from the inner member and disposed generally concentric thereto, at least two helically disposed inducer vanes between the inner member and the outer shroud, said inner member and outer shroud defining a relatively wide inlet for the inducer, and an outlet having a lesser diameter then the inlet and the passages between said vanes, said inner member and outer shroud being generally convergent flow passages between said inlet and said outlet and said inducer vanes having a positive incidence angle.

It is another object of the present invention to provide an inducer which, in first and second embodiments thereof, is readily utilizable to directly replace the first pumping stage of a multi-stage ring type centrifugal pump in the complete absence of special parts or adapters or modification of the pump and, in a third embodiment thereof, is readily utilizable to replace said first pumping stage through use of only two special pump components.

Accordingly, it is an object of the present invention to provide a new and improved inducer for use in multi-stage pumps which operates to materially lower the NPSH requirements of the latter.

Another object of the present invention is to provide an inducer which is operable throughout the entire pump flow range without substantial cavitation and turbulence.

Another object of the present invention is to provide an inducer which is utilizable in side suction, multi-stage ring type centrifugal pumps and end suction, multi-stage ring type centrifugal pumps.

A still further object of the present invention is to provide an inducer which, in one embodiment thereof, comprises an integral outer shroud and hub to thus enable the fabrication of the inducer as a single cast unit.

BRIEF DESCRIPTION OF THE DRAWINGS

Other objects and advantages of the present invention will be better understood by reference to the accompanying drawings in which.

DESCRIPTION OF THE PREFERRED EMBODIMENTS

Figure 1:
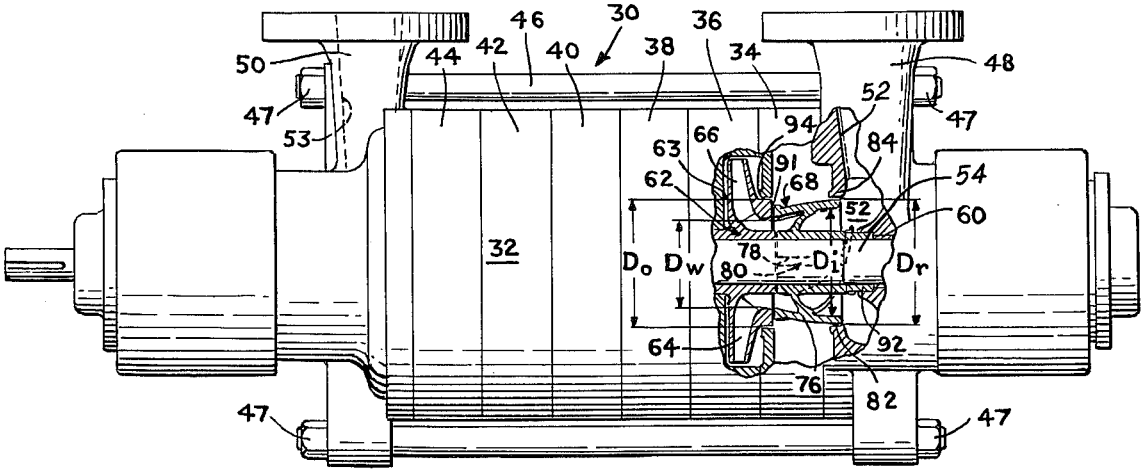
FIG. 1 is a side elevational view of a horizontal side suction donut pump, with parts broken away and parts in cross-section illustrating a first embodiment of the converging, axial flow inducer of my invention operatively disposed therein.
Figure 2:
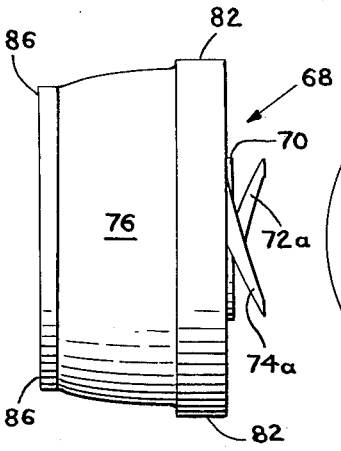
FIG. 2 is a side elevational view of the inducer of FIG. 1.

Referring now to FIG. 1, a horizontal side suction, multistage ring type centrifugal pump is indicated generally at 30 as having a casing 32 which includes, a plurality of ring-like casings for pumping stages as indicated at 34, 36, 38, 40, 42 and 44 retained in assembled position by tie rods 46 and tie rod locking nuts 47 to form the centrifugal pump.

A pump inlet end casing is indicated at 48, and a pump discharge end casing at 50. The pump inlet 48 forms the suction or inlet flow passage 52 and the discharge end casing forms the outlet flow passage 53. The suction or inlet flow passage 52 in the suction end casing 48 communicates with the first pumping stage 34 and the last of the pumping stage 44 discharges into the impeller means, not shown, operatively associated with the outlet passage 53 in the discharge end casing 50.

A pump shaft is indicated at 54 and is journalled for driven rotation in conventional mannerin bearings.

Only one of the pumping stages is illustrated in detail as indicated for pumping stage 36 which would generally be the second pumping stage. The pumping stage 36 comprises an impeller 62 and diffuser 63. The impeller conventionally includes a plurality of impeller vanes as indicated at 64 and 66.

The impeller and diffuser for the first pumping stage are not shown because the space or position normally occupied by these elements is now occupied by an axial flow inducer 68 in accordance with the teachings of the present invention, as is shown in FIGS. 1 to 9 of the drawings.

This inducer in accordance with the invention acts to directly replace the impeller and diffuser normally present in the first pumping stage 34 without requiring adapters or special parts to accomplish this purpose.

Further, in this illustrated embodiment, the inducer is a unitary member in which all the parts are integrally and fixedly connected or molded together. Preferably, the inducer is fabricated by sand casting and iso-curing molding techniques, with all cast surfaces being provided with a superior cast finish.

Referring now to FIGS. 2 to 9, the inducer 68 is shown as a cylindrical member which has its widest diameter at the front or inlet end **69*a* and its smallest diameter at the back or outlet end 69*b*. The inducer has an inner hub 70. An annular outer shroud 76 is held in spaced relationship to the hub by two generally helically shaped vanes 72 and 74**.

Except for the leading edges **72*a* and 74*a*, the inner edge of vanes 72 and 74 is fixedly connected to the hub 70 and the outer or peripheral portion of the vanes 72 and 74 is connected to the inner wall of the outer shroud 76**.

It will be noted that the leading edges **72*a* and 74*a* of the vanes 72 and 74 extend beyond the inlet end 69*a* of the inducer established by the inner hub 70 and the outer shroud 76. Further, in assembled position as will be clear from FIGS. 1 and 8, these leading edge portions extend into the suction or inlet flow passage 52 which is formed in the pump inlet end casing 48. This construction and the positive incidence angle of the leading edge help to increase the size of the inlet opening 69*a* and thereby permit establishing a suitable shape and curvature for the helical vanes 72 and 74** by which the desirable convergent flow paths are provided in inducers which achieve the advantages results of the present invention.

Figure 3:
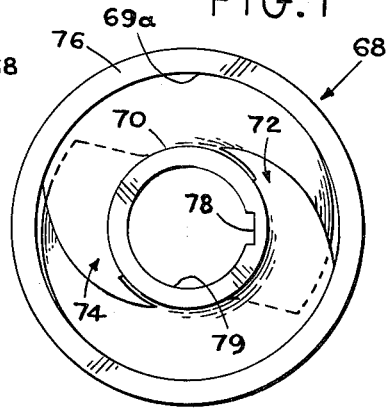
FIG. 3 is a front view of the inducer of FIG. 1.
Figure 4:
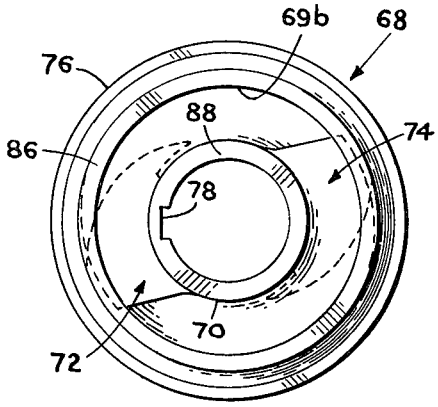
FIG. 4 is a back view of the inducer of FIG. 1.
Figure 5:
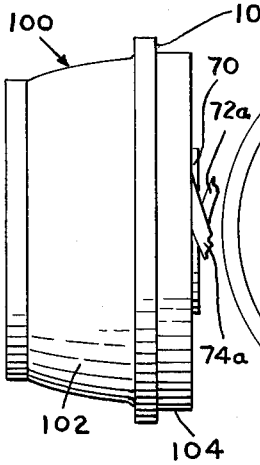
FIG. 5 is a side elevational view of a second embodiment of the inducer of my invention depicted in operative relationship with a stationary shroud.
Figure 7:
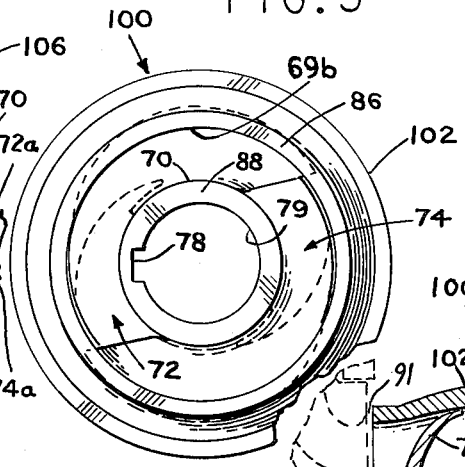
FIG. 7 is a back view of the inducer and shroud of FIG. 5.
Figure 6:
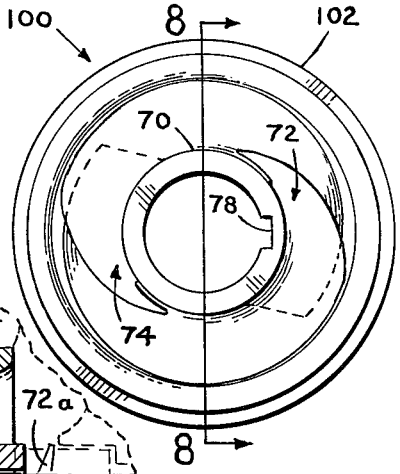
FIG. 6 is a front view of the inducer and shroud of FIG. 5.

The inducer is fixedly connected to and rotatable with the shaft 54 by a keyway 78 in the bore 79 of hub 70 and a complemental key 80 which is mounted in the shaft 54 as is shown in FIGS. 1, 3 and 4 of the drawings.

A wearing ring sealing surface 82 is provided on the outer shroud 76 of the inducer 68 and extends as shown in FIG. 1 into very close running clearance, of about 0.012 inch, with the partition 84 to help retain the pressure developed by the inducer 68.

The trailing face 86 of the outer shroud 76 has some clearance, due to manufacturing tolerance, with the adjacent leading faces of the second stage impeller 62 of the same order as indicated at 91 in FIG. 1. The trailing face 88 of the inner hub 70 however is held like all members on the shaft in abutment with the hub of impeller 62.

Since, the inducer 68 directly replaces the impeller and diffuser normally present if a first pumping stage was utilized in pump 30, it is desirable and essential that the external radial and axial dimensions of the inducer 68 be shaped and sized so that the inducer may be substituted for such first pumping stage impeller without any structural modification of any of the pump components, and completely without the need for any special parts in the nature of adapters or the like.

More specifically, and in addition to the obvious determinations of the radial dimensions of the bore and keyway in hub 70 to insure commonality with pump shaft 54, these determinations of essential inducer dimensions will include a choice of the thickness of inducer hub 70 to substantially equal that of the adjacent face of the hub of second stage impeller 62 to insure a smooth transitional fluid flow passage therebetween, and a choice of the overall axial extent of the inducer 68 to insure that the same will fit precisely between the second stage impeller 62 and spacer sleeve 92 in the same manner as would the first stage impeller which is replaced by the inducer.

Further, however, the diameter $D_o$ of the wearing ring surface 94 of the second stage impeller and all subsequent impellers is made equal to the diameter $D_r$ (FIG. 1) of the inducer wearing ring surface 82 and therefore produces a somewhat thicker impeller wall about the suction eyes of the respective impellers than would normally be provided and this is to insure the same running clearance between the impellers and the casing member 84 as exists when the inducer 68 is used to replace the first stage impeller. Further in order to provide for the desired convergence in an inducer by which the significant performance advantages are achieved in accordance with the present invention as is more fully described below, the diameter $D_i$ of the inlet for the inducer 68 can be from 5% to 25% larger than the diameter $D_w$ of the suction eye of the impeller 62 of the pumping stage 36. More particular, the diameter $D_i$ of the inlet of the inducer may be in a range from 10% to 20% and preferably for optimum performance the diameter $D_i$ of the inlet of the inducer will be in a range from 11% to 18% of the diameter $D_w$ of the suction eye of the first impeller of the plurality of pumping stages with which the inducer is operatively associated.

Figure 8:
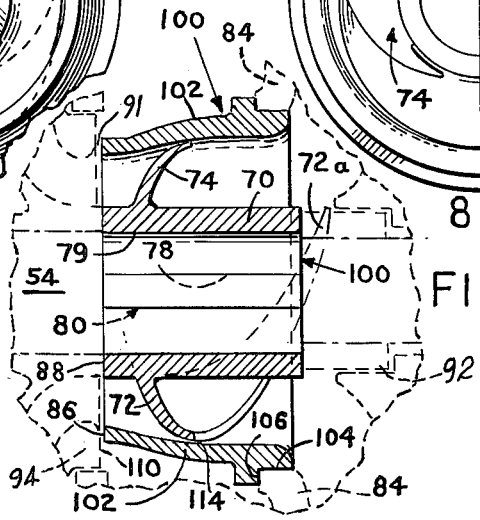
FIG. 8 is a cross sectional view taken along line 8—8 in FIG. 6, and includes operatively related pump components as shown in FIG. 1 to illustrate the operative relationship of this embodiment of the inducer to the pump.
Figure 10:
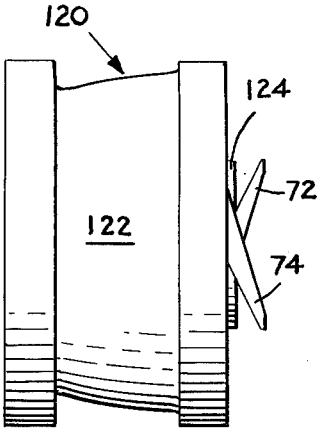
FIG. 10 is a side elevational view of a third embodiment of the inducer of my invention depicted in conjunction with a separate shaft sleeve.
Figure 11:
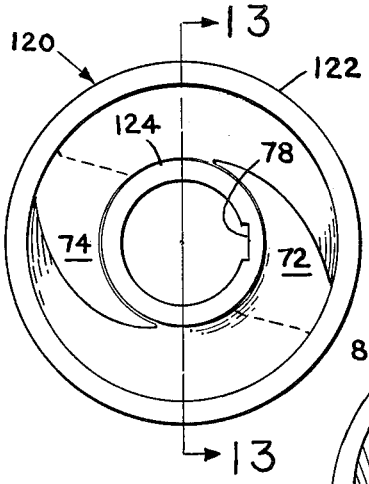
FIG. 11 is a front view of the inducer of FIG. 10.
Figure 9:
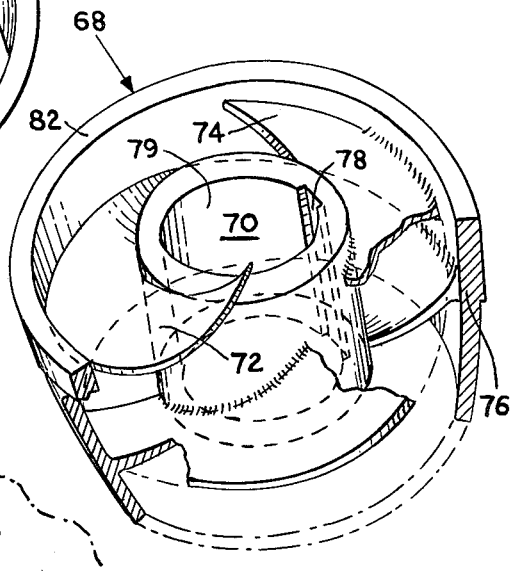
FIG. 9 is a perspective view of the inducer of FIGS. 1–4 with parts broken away to illustrate the internal construction thereof.
Figure 12:
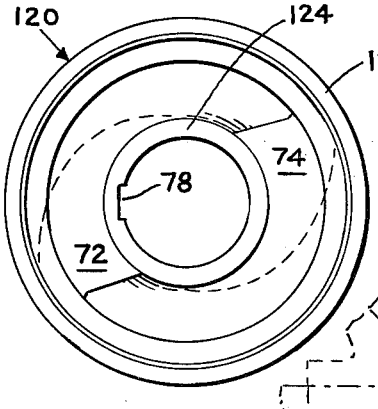
FIG. 12 is a back view of the inducer of FIG. 10.

A second, or male, embodiment of the inducer in adcordance with the present invention is indicated generally at 100 in FIGS. 5 through 8. This form of the invention is substantially similar to the inducer 68 with the exception that the outer shroud as indicated at 102 is formed independently of the integral hub 70 and vanes 72 and 74 and is mounted and carried by the partitions formed in the casing for the pump 30. As best seen in FIG. 8, relatively extensive and carefully machined locating surfaces 104 and 106 are provided on the periphery of outer shroud 102 adjacent the upstream or inlet edge thereof, and these locating surfaces are abutted by the complementally configured surfaces of the pump partition member 84 to fixedly and accurately locate the outer shroud 102 within pump 30. Preferably, a simple interference fit is utilized to mount the outer shroud in assembled position, although it will be readily apparent to those skilled in this art that other and different types of attachment may be utilized for this purpose. The downstream or outlet edges of the outer shroud 102 will terminate short of the leading surface 110 of the rotating second stage pump impeller 62 and a clearance will exist by reason of manufacturing tolerances as is shown at FIG. 8 of the drawings.

Since the vanes 72 and 74 are not connected to the outer shroud 102, a running clearance as at 114 is provided therebetween. This is made as small as possible to maximize performance. Such clearance is normally limited under conventional manufacturing and assembly of the inducer to tolerances of approximately 0.020 inch.

A third, or female, embodiment of the inducer of my invention is indicated generally at 120 in FIGS. 10 through 13. This inducer also has substantial similarities to inducer 68 with the exceptions that the inducer vanes 72 and 74 in this third embodiment, are integral with the outer shroud as indicated at 122. No inducer hub is required. The hub space is replaced by a separate shaft sleeve 124 of substantially the same axial and radial dimensions to establish in the inducer 120 the required fluid flow passages and for proper replacement of the impeller from the first pumping stage.

Figure 13:
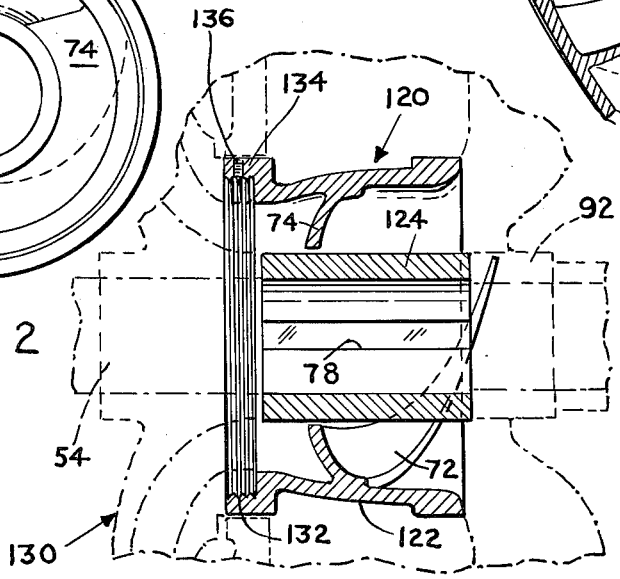
FIG. 13 is a cross sectional view taken along line 13—13 in FIG. 11 and includes operatively related pump components as shown in FIG. 1 to illustrate the operative relationship of this embodiment of the inducer to the second stage impeller of a centrifugal pump.

FIG. 13 makes clear that the separate shaft sleeve 124 extends between and into firm abutment at one end with the shaft sleeve 92 and at the other end with the leading edge of the hub of a special second stage pump impeller 130.

In order to use the female inducer 120 of FIGS. 10 through 13 in a ring type pump 30 of FIG. 1, the special second stage impeller 130 is required and will include an appropriately threaded cylindrical mounting portion 132 formed at the leading face thereof. In like manner, the shroud 122 of inducer 120 includes an internally complementally threaded cylindrical mounting portion 134 which is threadably connected to the impeller mounting portion 132 to fixedly attach the inducer 120 to the second stage impeller 130. This construction supports and on driven rotation of the impeller will rotate and drive the inducer 120.

Since the standard direction of rotation of the ring type pump 30 is counterclockwise as viewed from the suction end, standard right hand threads are utilized here so that the attachment of the inducer will tighten with operation of the pump. In addition, a suitable thread locking compound, and/or a set screw as indicated at 136 may also be utilized to prevent unscrewing of the inducer in the event of inadvertent clockwise rotation of the pump shaft 54.

By all of the above it is believed made clear that the respective embodiments of the inducer of my invention as indicated at 68 in FIGS. 1 through 4 and at 100 in FIGS. 5 through 8, each directly replace the first stage impeller and diffuser of the ring type multi-stage centrifugal pump 30 without the need for any adapters or any special parts, or any modification of the pump.

The embodiment of the inducer of my invention as indicated at 120 in FIGS. 10 through 13 again directly replaces said first stage pump impeller although, in this instance, a separate shaft sleeve 124 and special second stage pump impeller 130 are required to, in any event, again enable ready utilization of the inducer without major modification of the pump.

Figure 14:
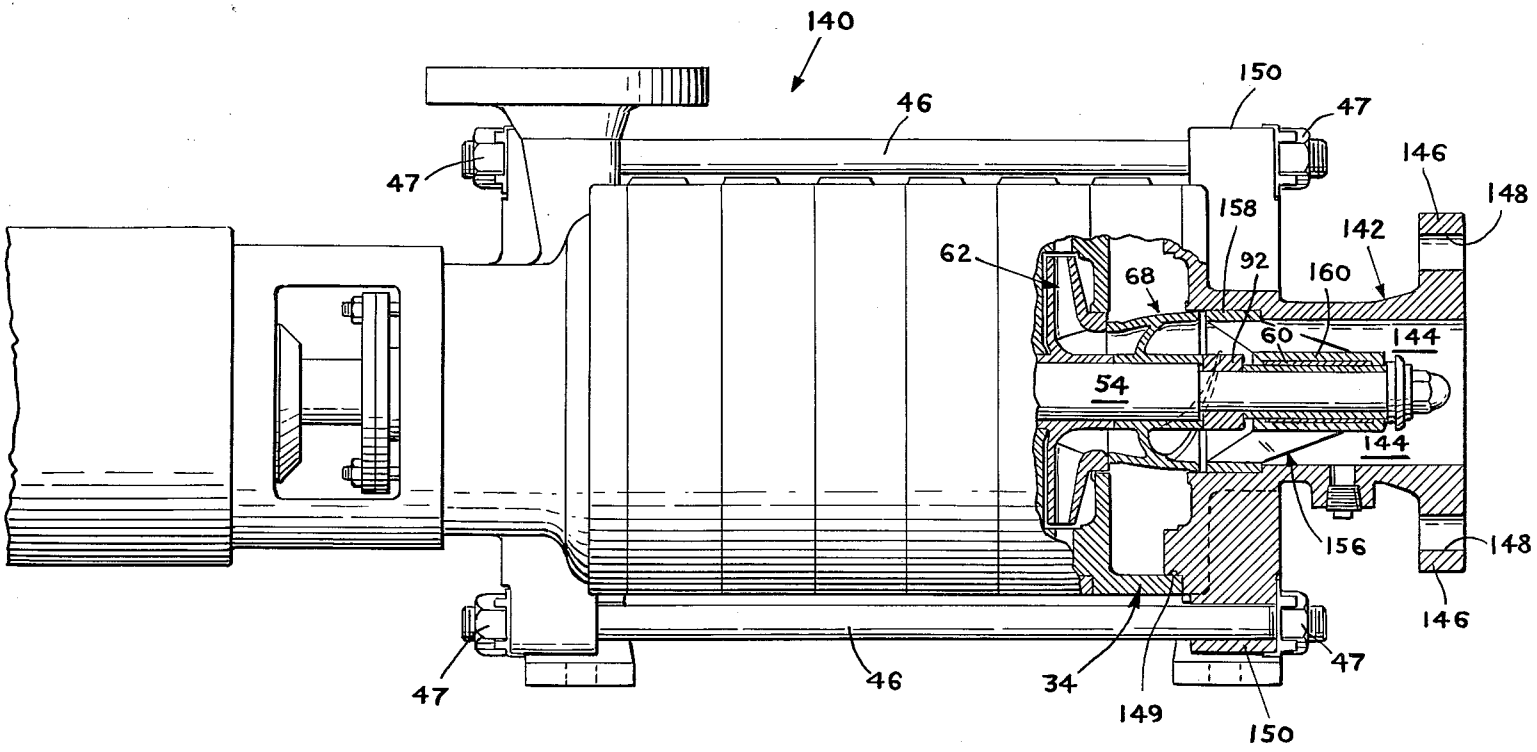
FIG. 14 is a side elevational view, with parts broken away and parts in cross section, of a horizontal end section donut pump illustrating the utilization of the embodiment of the inducer of FIGS. 1 through 4 in said pump.

Referring now to FIG. 14, a horizontal, multi-stage ring type end suction centrifugal pump is indicated generally at 140 and may readily be seen to be similar to the pump 30 of FIG. 1 with the exception that the former utilized a side inlet for the suction or inlet passage.

Figure 18:
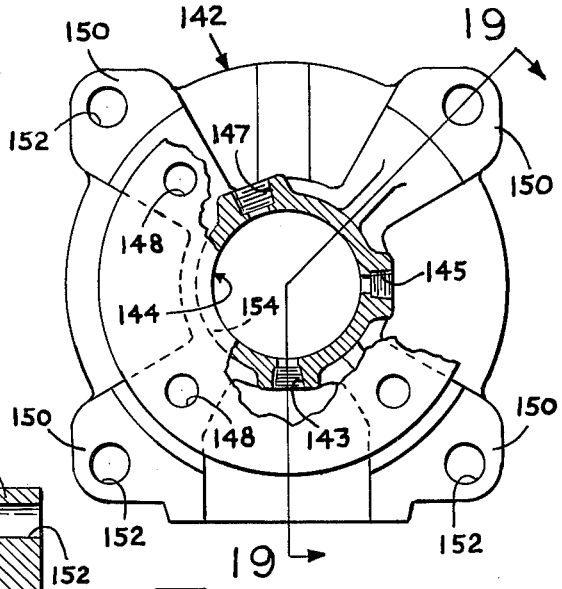
FIG. 18 is an elevational view of the outer face of the suction casing of FIG. 17, and includes parts broken away and parts in cross-section.

Pump 140 comprises an end casing as indicated generally at 142 in FIGS. 14, 17, 18 and 19, which forms a central suction or inlet passage 144 extending therethrough; and includes mounting flanges 146 which include mounting apertures 148 extending therethrough for obvious use in the attachment of appropriate piping, not shown, for leading fluid to be pumped to the pump 140. Further included in the end casing 142 are tapped bores 143, 145 and 147 which extend as best seen in FIG. 18 into fluid flow communication with the inlet flow passage 144 for fluid introduction and/or bleed-off purposes; and four assembly lugs 150 which comprise tie rod apertures 152 extending therethrough. In assembled position the end casing 142, abuts ring-like pump casing member 34 and an "O" ring 149 disposed therebetween in groove 145 will provide a fluid-tight seal. The tie rods 46 extend through apertures 152 in assembly lugs 150, and the tie rod locking nuts 47 and the tie rods hold the pumping stages in assembled relation.

Figure 15:
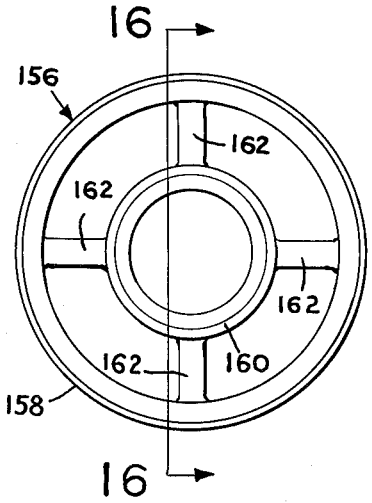
FIG. 15 is a front elevational view of the bearing bracket utilized in the end suction pump of FIG. 14.
Figure 16:
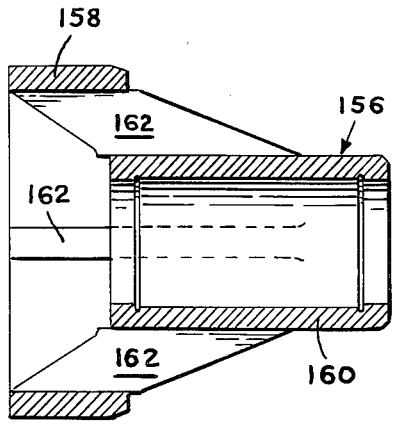
FIG. 16 is a cross-sectional view taken along line 16—16 in FIG. 15.
Figure 17:
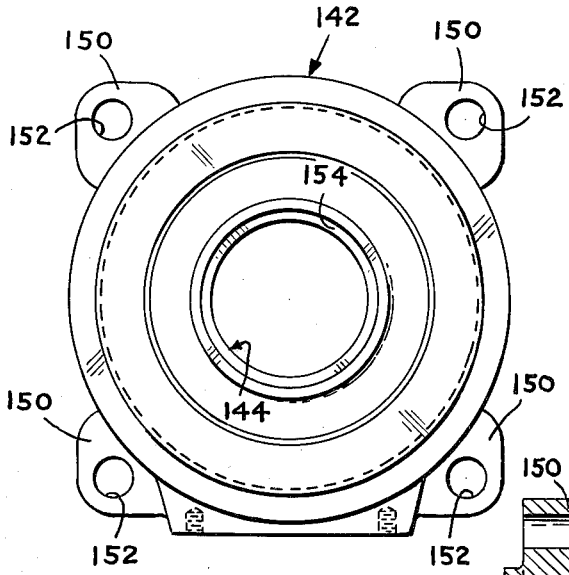
FIG. 17 is an elevational view of the inner face of the suction casing utilized in the end suction pump of FIG. 14.
Figure 19:
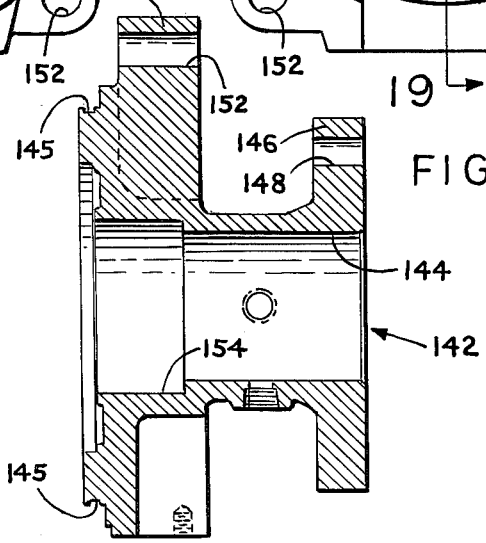
FIG. 19 is a cross sectional view taken along line 19—19 in FIG. 18.

A bearing bracket mounting groove 154 is formed in the end casing 142 in the manner best seen in FIG. 19, and a bearing bracket as indicated at 156 in FIGS. 14, 15 and 16 is disposed in said mounting groove. The bearing bracket comprises, an outer cylindrical member 158, and an inner cylindrical member 160 which is supported from the former by web-like members 162 and in turn supports the bearing 60 for pump shaft 54 as is shown in FIG. 14.

Inducer 68, shown in FIGS. 1 to 4 may be operatively positioned in the manner shown in FIG. 14 and may again be understood to directly replace the first stage impeller of the first pumping stages for the multi-stage ring type centrifugal pump 140 without requiring any special parts or adapters, or any substantial modification of the pump. In like manner, inducer 100 shown in FIGS. 5 to 8 could just as readily be utilized in pump 140, without special parts or pump modification; and that inducer 120 shown in FIGS. 10 to 13 could also be utilized in pump 140 through use of a spacing sleeve 124 and special second stage impeller 130.

PERFORMANCE OF THE INDUCER

The basic function of the inducer in accordance with the present invention, like that of any other inducer, is to permit the pump to operate at a lower NPSH over a given flow range than would be possible through use of a first stage impeller in the pump.

For this objective to be achieved, the flow velocities and turbulence in the eye of the inducer must be maintained at lower levels than those in the eye of the impeller to reduce local pressure drops and prevent cavitation. In addition, the static pressure in the suction eye of the second stage impeller must be increased to prevent cavitation transfer from the inducer to the impeller.

Briefly summarized, the inducer must have the capability of functioning at a lower NPSH than the impeller without generating damaging and flow-throttling vapor bubbles while, at the same time, increasing the static pressure at the eye of the first stage impeller to avoid cavitation there.

This essential reduction in the velocities in the eye of the inducer in accordance with the present invention is effected by increasing the inducer inlet area as a function of the area of the suction eye of the first impeller of the plurality of pumping stages with which the inducer is operatively associated in the ranges described hereinabove with respect to inducer 68 of FIG. 1, the preferred diameter $D_i$ of the inducer to the diameter $D_w$ of the suction eye of said operatively associated first impeller being in a range from 11% to 18%; and this permits the formation of the convergent shape for the flow passage through the inducer which results from $D_i$ being greater than the impeller eye diameter $D_w$ the equivalent inducer discharge diameter, again as discussed hereinabove with regard to FIG. 1.

Additionally, reduction in inducer eye velocities is effected by reducing the number of inducer vanes to two. The reduction in the number of inducer vanes reduces inducer vane flow-blockage and acts to enlarge the inducer throat area as illustrated in FIG. 21.

It will be understood by those skilled in this art that the enlargement of the inducer throat area is advantageous because a larger throat area is much less apt to become restricted if vapor bubbles are generated in the fluid flowing through the passages formed between the inducer vanes.

Figure 20:
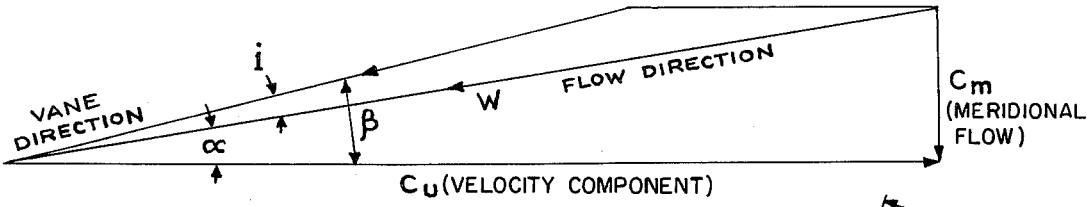
FIG. 20 depicts the inlet velocity triangles for the inducer of the invention.
Figure 21:
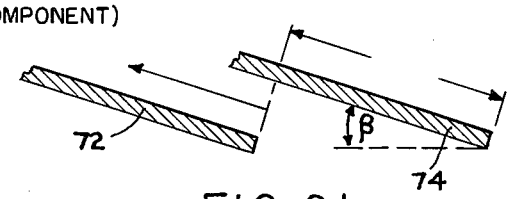
FIG. 21 is a segmental cross-sectional view illustrating the inducer throat area.

Minimization of turbulence at the eye of the inducer of my invention is accomplished by determining the magnitude of the inlet vane angle $\beta$ as illustrated in FIGS. 20 and 21 to be slightly larger than the angle of the relative design flow direction $\alpha$ as illustrated in FIG. 20 to thereby provide a positive incidence angle for the inducer vanes. As a practical matter, the incidence angle $i$ will normally have a value of less than 10°; while the inlet vane angle $\beta$ may, for example, have a value of 18°. FIG. 20, of course, makes clear that the incidence angle $i$ is equal to $\beta$ minus $\alpha$.

The pressure which must be developed by the inducers in accordance with the present invention in order to prevent cavitation at the impeller eye is generated by centrifugal or vortex fluid motion which results from counterclockwise rotation of the inducer.

The net result, with a properly designed inducer, in accordance with the present invention, is essentially the same pressure generation as would be expected from the second-stage impeller in the absence of the inducer but with a substantially lower NPSH requirement for the pump.

Actual tests of inducers in accordance with the present invention in replacement position of the impeller for the first pumping stage in a side inlet multi-stage ring type centrifugal pump such as pump 30 of FIG. 1 or in an end inlet multi-stage ring type centrifugal pump such as pump 140 of FIG. 14 have resulted in reduction in the NPSH required by the side inlet type pump of about 50% at the design flow rate for the best pump efficiency point, and in reduction in the NPSH required by the end inlet type pump of about 75% again at the design flow rate for the best pump efficiency point.

Various changes may of course be made in the disclosed embodiments of the inducer of my invention without departing from the spirit and scope of the present invention as now defined in the appended claims.

What is claimed is:

1. In a multi-stage ring type centrifugal pump,
   a. pump casing means,
   b. said pump casing means having an inlet for fluid to be pumped, and an outlet for pumped fluid,
   c. a pump shaft rotatably mounted in said casing,
   d. a plurality of serially arranged pumping stages having impellers therein connected to and driven by said pump shaft, said pump casing inlet and said pump shaft constructed to accomodate a removable first impeller and diffuser stage of said serially arranged pumping stages, e. inducer means in said pump casing means removably associated with said shaft and with said pump casing inlet and occupying a position normally occupied by said first impeller and diffuser stage, f. said inducer means having an inducer inlet in communication with said inlet for the pump and having an inducer outlet disposed to deliver pumped fluid to the suction eye of the impeller of the adjacent one of the plurality of serially arranged pumping stages, and g. said plurality of serially arranged pumping stages connected to deliver pumped fluid to the outlet in said pump casing means.

2. In the multi-stage ring type centrifugal pump as claimed in claim 1 wherein the inducer means defines generally helically converging flow passage therethrough.

3. In a multi-stage ring type centrifugal pump as claimed in claim 1 wherein said at least two inducer vanes each include, a. a leading edge, and b. said leading edge of the at least two inducer vanes are disposed to extend beyond the plane of the inlet for said inducer means.

4. In the multi-stage ring type centrifugal pump as claimed in claim 3 wherein said inducer means includes, a. an inner member, b. an annular outer shroud spaced from said inner member and disposed generally concentric thereto, c. at least two helically disposed inducer vanes between the inner member and the outer shroud, d. said inner member and outer shroud defining an inlet for the inducer at least wider than the respective suction inlet of the inducer for the said impellers, and an outlet for the inducer having a lesser diameter than the inlet, e. said at least two inducer vanes and the inner member and outer shroud defining at least two generally helical converging flow passages between said inlet and said outlet, and f. said inducer vanes having an angled leading edge such that the incidence angle of the fluid entering the said helical converging passages will be positive.

5. In the multi-stage ring type centrifugal pump as claimed in claim 3 wherein the inlet diameter of the inducer is between 11% and 18% greater than the outlet diameter of the inducer.

6. In the multi-stage ring type centrifugal pump as claimed in claim 4 wherein, the inlet diameter of the inducer is between 5% and 25% greater than the outlet diameter for the inducer.

7. In the multi-stage ring type centrifugal pump as claimed in claim 4 wherein, the magnitude of the inlet vane angle $\beta$ of the inducer vanes is slightly larger than the magnitude of the relative design flow direction $\alpha$ through the inducer to thereby provide said positive incidence angle $i$ for each inducer vane.

8. In the multi-stage ring type centrifugal pump as claimed in claim 4 wherein said inner member, said annular outer shroud, and said inducer vanes are integral.

9. In the multi-stage ring type centrifugal pump as claimed in claim 1 wherein said inducer means includes, a. an inner member, b. an annular outer shroud spaced from said inner member and disposed generally concentric thereto, c. at least two helically disposed inducer vanes between the inner member and the outer shroud, d. said inner member and outer shroud defining an inlet for the inducer, at least wider than the respective suction inlets for the said impeller and an outlet for the inducer having a lesser diameter than the inlet of the inducer, e. said at least two inducer vanes and the inner member and outer shroud defining at least two generally helically converging flow passages between said inlet and said outlet, and f. said inducer vanes having an angled leading edge such that the incidence angle of the fluid entering the said helical converging passages will be positive

10. In the multi-stage ring type centrifugal pump as claimed in claim 9 wherein, the inlet diameter of the inducer is between 5% and 25% greater than the outlet diameter for the inducer.

11. In the multi-stage ring type centrifugal pump as claimed in claim 9 wherein, the magnitude of the inlet vane angle $\beta$ of the inducer vanes is slightly larger than the magnitude of the relative design flow direction $\alpha$ through the inducer to thereby provide said positive incidence angle $i$ for each inducer vane.

12. In the multi-stage ring type centrifugal pump as claimed in claim 9 wherein said inner member, said annular outer shroud, and said inducer vanes are integral.

13. In the multi-stage ring type centrifugal pump as claimed in claim 9 wherein the inlet diameter of the inducer is between 11% and 18% greater than the outlet diameter of the inducer.

14. In the multi-stage ring type centrifugal pump as claimed in claim 13 wherein the selected inlet vane angle $\beta$ of the inducer vanes is slightly larger than the magnitude of the angle relative design flow direction $\alpha$ through the inducer to provide said positive incidence angle $i$ for each of the inducer vanes.

15. In the multi-stage ring type centrifugal pump as claimed in claim 9 wherein said inner member and said inducer vanes are integral, and said annular outer shroud is formed separately thereof.

16. In the multi-stage ring type centrifugal pump as claimed in claim 15 wherein the periphery of each of the inducer vanes is disposed for minimum clearance relative the inner wall of the annular outer shroud.

17. In the multi-stage ring type centrifugal pump as claimed in claim 9 wherein, said annular outer shroud and said inducer vanes are integral, and said inner member is formed separately thereof and operatively connected on said pump shaft.

18. In the multi-stage ring type centrifugal pump as claimed in claim 17 wherein, a. said centrifugal pump has one of said impellers in the beginning one of said plurality of serially arranged pumping stages, and b. said annular outer shroud is connected to and is rotatable with said one of said impellers in the beginning one of said plurality of serially arranged pumping stages.

19. An inducer for use in a multi-stage ring type centrifugal pump having a plurality of serially arranged pumping stages with impellers therein, said inducer comprising, a. an inner member, b. an annular outer shroud spaced from said inner member and disposed generally concentric thereto, c. a plurality of generally helical inducer vanes disposed between the inner member and the outer shroud, d. said inner member and outer shroud defining an inlet for the inducer, at least wider than the respective suction inlets for the said impellers and an outlet for the inducer having a lesser diameter than the inlet, e. the inducer vanes, inner member and outer shroud defining at least two generally helically converging flow passages between said inlet for the inducer and said outlet for the inducer, and f. said inducer vanes having an angled leading edge such that the incidence angle of the fluid entering the said helically converging passages will be positive, and g. said angled leading edges of the inducer vanes are disposed to extend beyond the plane of the inlet for said inducer.

20. In an inducer as in claim 19 wherein, the inlet diameter of the inducer is between 5% and 25% greater than the outlet diameter of the inducer.

21. In an inducer as in claim 19 wherein, the selected inlet vane angle $\beta$ of the inducer vanes is slightly larger than the magnitude of the angle of the relative design flow direction $\alpha$ through the inducer to thereby provide a positive incidence angle $i$ for each of the inducer vanes.

22. In an inducer as in claim 19 wherein, said inner member, said annular outer shroud, and said inducer vanes are integral.

23. In an inducer as in claim 19 wherein, said annular outer shroud and the inducer vanes are integral, and said inner member is formed separately thereof.

24. In an inducer as claimed in claims 19 wherein, the inlet diameter of the inducer is between 11% and 18% greater than the outlet diameter of the inducer.

25. In an inducer as claimed in claim 24 wherein, the selected inlet vane angle $\beta$ of the inducer vanes is slightly larger than the magnitude of the angle of the relative design flow direction $\alpha$ through the inducer to thereby provide a positive incidence angle $i$ for each of the Inducer vanes.

26. In an inducer as in claim 19 wherein, said inner member and said inducer vanes are integral, and said annular outer shroud is formed separately thereof.

27. In an inducer as claimed in claim 26 wherein the periphery of each of the inducer vanes is disposed for minimum clearance relative the inner wall of the annular outer shroud.

* * * * *